United States Patent [19]

Grimshaw

[11] 4,268,937

[45] May 26, 1981

[54] METALLIC WIRE TYPE CARD-CLOTHING

[75] Inventor: Keith Grimshaw, Todmorden, England

[73] Assignee: The English Card Clothing Company Limited, Huddersfield, England

[21] Appl. No.: 42,113

[22] Filed: May 24, 1979

[30] Foreign Application Priority Data

May 25, 1978 [GB] United Kingdom ..... 22658/78

[51] Int. Cl.[3] ..... D01G 15/88

[52] U.S. Cl. ..... 19/114

[58] Field of Search ..... 19/114

[56] References Cited

U.S. PATENT DOCUMENTS 3,528,137 9/1970 Rotsaert ..... 19/114

FOREIGN PATENT DOCUMENTS 711646 7/1954 United Kingdom ..... 19/114

854090 11/1960 United Kingdom .

933834 8/1963 United Kingdom ..... 19/114

*Primary Examiner*—Louis Rimrodt

*Attorney, Agent, or Firm*—W. Thad Adams, III

[57] ABSTRACT

Interlocking metallic wire type card-clothing has a male section protruding from one flank of its rib and a female section formed in the other flank of the rib. The pitch width of the rib is not more than 1.65 millimeters (giving not less than 16 turns per 25 millimeters length of the roller) and the maximum depth of the female section is not substantially greater than half the pitch width of the rib.

10 Claims, 3 Drawing Figures

METALLIC WIRE TYPE CARD-CLOTHING

Figure 1:
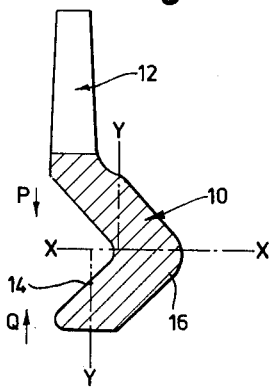

Metallic wire card-clothing comprises a long length of wire having saw-like teeth formed in one edge. In cross-section, the wire has a base or rib and a tooth portion upstanding from the rib, the rib being wider than the tooth portion. The wire is applied to the carding machine roller or cylinder, or the roller of some other apparatus such as an opening roller in an open-end spinning apparatus, by winding helically on to the roller or cylinder. In some instances, the wire is wound on to the surface of the roller with adjacent convolutions abutting each other, and in that case the cross-sectional shape of the wire ensures that the teeth on one convolution are spaced axially (with respect to the roller) from the teeth of the adjacent convolutions.

It is known to produce interlocking metallic wire type card-clothing, that is card-clothing in which the rib of the wire is formed with a protrusion or male section along one flank and a corresponding recess or female section along the other flank into which the male portion can be engaged. When the wire is wound on to the roller or cylinder, the male section of each convolution fits into the female section of an adjacent convolution (except for the male section of the convolution at one end of the roller or cylinder).

When a card-clothed roller is in operation, loads applied to the teeth of the wire, if the wire is of the non-interlocking type, sometimes tend to cause rib breakage, and if a rib does break, then the wire in the vicinity of the break springs away from the roller, and this can cause quite severe damage to the machine in which the card-clothing is used. However, if interlocking wire is used, the interference fit produced by the interengagement of the male and female sections provides a resistance to rib breakage, when the wire is wound on to the roller or cylinder, because the loads applied through the teeth to the rib are distributed by the interference fit over more than one convolution of the wire. Hence, even if the rib is completely broken, the wire will remain in place on the roller, thereby minimising any damage to the machine.

One form of interlocking wire is described and illustrated in the Specification of United Kingdom Pat. No. 854,090, which discloses male and female sections of V-shape cross-section. There are certain disadvantages associated with the use of V-type interlocking wire, one being that if the wire is of relatively small rib pitch width, there is a tendency for the female section to close up during winding of the wire on to the roller, especially if the roller is of small diameter and if this happens, it is not possible to seat the male section properly in the female section. This introduces a practical limitation on the fineness of rib pitch width, which can be manufactured with the interlocking feature. "Pitch width" is the width of the rib measured from one flank to the other, as set out in the Draft International Standard ISO/DIS 5234.

Objects of the invention include:

- providing an interlocking metallic wire card-clothing which is easier to apply to a roller a cylinder of a carding machine than the known interlocking wire;
- providing an interlocking metallic wire card-clothing which can be readily manufactured, and
- enabling the manufacture of interlocking card-clothing of finer pitch than those which can be made in the V-type shape.

According to this invention, interlocking metallic wire type card-clothing has a rib and a tooth portion, a male section protruding along one flank of the rib and a female section formed in the other flank of the rib, the pitch width of the rib being not greater than 1.65 millimeters and the maximum depth of the female section, measured from the flank of the female side of the rib and perpendicular to that flank, being not substantially greater than half the pitch width of the rib.

Preferably the maximum depth of the female section is not more than 0.7 millimeters, and it is further preferred, that the maximum depth of the female section is not more than 0.5 millimeters. Further, it is preferred that the maximum depth of the female section is not greater than the theoretical thickness of the tooth portion at the root of the tooth (measuring the theoretical tooth thickness at the root by ignoring any radius joining the tooth portion to the rib, and considering the point of intersection of the projected tooth flank with the projected shoulder of the rib). More specifically, it is preferred that the maximum depth of the female section is not more than 0.8 times the theoretical thickness of the tooth portion at the root of the tooth.

By limiting the maximum depth of the female section, the manufacture of card-clothing wire is facilitated, and in addition, any tendency for the female section to close up on itself, during winding of the wire on to the roller is minimised. Consequently, it is possible to manufacture and use interlocking card-clothing wire, having pitch widths smaller than those on which the interlocking feature has been used up till now. For example, it has been found possible to manufacture interlocking wire in accordance with the invention, in which the pitch width of the rib is not more than 1.1 millimeters. Indeed, wire has been manufactured, having the interlocking feature, and a pitch width of not more than 0.92 millimeters, and it is believed that interlocking wire in accordance with the invention could be made very fine indeed, down to pitch widths of no more than say 0.40 millimeters.

According to another preferred feature of the invention, the male section has a cross-section corresponding substantially to that of the female section, so that it is adapted to fit snugly into the female section of an adjacent convolution of the wire. It is also preferred that the rib is generally of rectangular cross-section with the rib height being greater than the rib pitch width, and with one flank of the tooth portion forming a continuation of the female flank of the rib.

Figure 2:
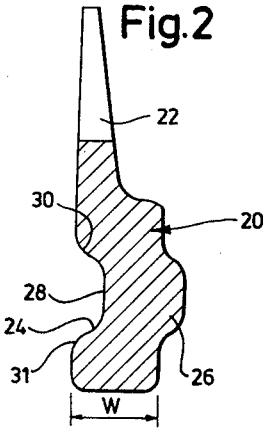
PRIOR ART Fig.2
Figure 3:
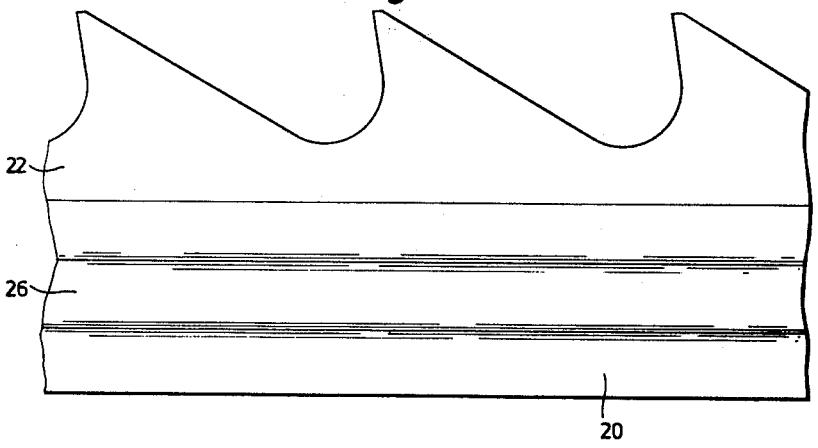

One construction of metallic wire type card-clothing in accordance with the invention will now be described by way of example only with reference to the accompanying drawings, in which:

FIG. 1 is a cross-section through a known type of interlocking card-clothing, FIG. 2 is a cross-section through interlocking card-clothing in accordance with the invention, and FIG. 3 is a side view of the card-clothing shown in FIG. 2.

Referring first to FIG. 1, there is illustrated metallic wire card-clothing of an interlocking kind and of a design which has now been in use for some years. The wire has a rib 10 and an upstanding tooth portion 12 one flank of the tooth portion being an upward continuation of a female flank of the rib, but the rib projects appreciably to the other side of the tooth portion. Teeth are formed in the tooth portion by known means.

The rib 10 has a deep V-shaped female recess or section 14 formed in its female side and a corresponding male projection 16 formed on its opposite side. In fact, the female and male formation are so large relatively to the cross-sectional dimensions of the rib, that the latter can be considered as being V-shaped in cross-section, the V being turned on its side. It is to be noted that the converging sides of the female section are inclined at approximately 45° to a horizontal plane (i.e. to a line perpendicular to the female flank of the rib).

When the wire shown in FIG. 1 is wound on to a roller or cylinder of a textile carding machine, with adjacent convolutions pressed against each other, the male portion of one convolution is intended to engage snugly in the female portion of the convolution immediately to the right (viewing the wire as in FIG. 1). The shape and size of the male portion are such that it fits closely to the contours of the female portion.

During a carding operation, loads are applied to the teeth of the card-clothing, and these stress the rib and can lead to rib breakage. Of course, it this happens with non-interlocking wire, the wire in the vicinity of the breakage springs away from the roller or cylinder and necessitates re-clothing that roller or cylinder, and frequently causes severe damage to other parts of the machine. However, due to the interference fit produced by the male and female formations of the wire, any load applied on the wire which would tend to break the wire is distributed over two or more convolutions of the wire, and hence the interlocking wire is much less liable to this kind of breakage than non-interlocking wire. In fact, in a typical instance with a wire which is intended to be wound with approximately one turn per millimeter axial length of the roller, the intended interference is at least 0.75 millimeters, which ensures very firm resistance to wire breakage. Even if the rib does break, it will not spring away from the roller, due to its interference fit with adjacent convolutions.

Now whilst V-type interlocking wire as shown in FIG. 1 is quite satisfactory for card-clothing having a rib pitch width greater than 1.65 millimeters (giving approximately 16 turns or less per 25 millimeters axial length of the roller) problems arise, in the fitting of the wire on to the roller, if it is made in the form shown in FIG. 1, and with a pitch width less than 1.65 millimeters. Essentially, the open mouth provided by the female section tends to close during winding on to the roller, and the smaller the diameter of the roller, the greater is there a tendency to close the female section. A theoretical explanation of this is as follows:

Ignoring the tooth portion 12, and considering only the V-shaped rib 10, the rib can be regarded as a beam which is being bent about the axis of the roller, the internal diameter of the beam being determined by the outside diameter of the roller. This means that the parts of the beam above the median horizontal axis (shown at X—X in FIG. 1) are placed in tension, and those parts below the X—X axis are placed in compression. In other words, there is an attempt to store energy in the upper and lower portions of the rib, and the energy force increases away from the X—X axis. The beam constituted by the rib 10, therefore acts as a spring, which attempts to release the stored energy, by inward movement of the parts above the X—X axis, and outward movement of the parts below the X—X axis. Where there is material above and below the X—X axis, there is no resultant movement, because the outwardly applied force equals the inwardly applied force. However, if one considers the upper part of the rib 10 above the recess formed by the female section, inwardly applied force in the direction of the arrow P creates a turning moment of the upper portion about a vertical line shown at Y—Y in FIG. 1 passing through the upper part of the rib down to the position of maximum penetration of the female section, then along the X—X axis and then vertically again through the centre of the pitch width of the lower part of the rib. Similarly, the lower part of the rib attempts to move upwardly in the direction of the arrow Q in FIG. 1, but since there is a much greater applied force attempting to press the entire section downwardly into contact with the surface of the roller, there is no actual upward movement of the lower part of the rib—though this may in effect increase the relative downward movement of the upper part in the direction of the arrow P.

There is thus an effective couple acting to close the mouth of the female section and it will be apparent, that the turning moment increases with the depth of penetration of the female section (that is the horizontal distance measured on the X—X axis, from the lefthand flank of the wire as seen in FIG. 1, to the point of maximum penetration of the female section).

When the converging top and bottom sides of the female section tend to approach each other, closing the female section to some extent, this prevents the male section fitting correctly into the female section. As a result, it is sometimes not possible to wind the correct number of turns of the wire on to a given axial length of the roller or cylinder, particularly if the roller is of small diameter. To take a specific example, interlocking wire of the form shown in FIG. 1 has been designed with a rib pitch width, which should produce 24 convolutions per 25 millimeters axial length of the roller, but it is commonly found, that only 22 rows can be actually applied per 25 millimeters axial length, simply because the closure of the female sections means that the male sections are not able to penetrate to the full depth into the female sections, and of course this indicates somewhat inadequate mating of the male and female sections, as well as placing a limitation on the number of convolutions per unit length of the roller. In general, it can be said that the problem has prevented the correct application of interlocking V-shaped wire, on card-clothing of less than 1.65 millimeters pitch width.

It has been recognised for some time, that for certain carding operations, it is desirable to have a high population density of teeth, and one way of achieving this, is to use a larger number of convolutions per unit of the width of the carding machine roller—that is card-clothing wire of small pitch width. The invention is based on the appreciation of the fact that it is not necessary, as has been previously thought, to provide as large an interference as possible between adjacent convolutions, and that in any case, it is better to have a lower interference and more effective location of the male section in the female section, than to have large interference with possible incorrect location. This is especially true of card-clothing wire of small overall cross-section, such as is required to provide a high tooth population on the roller, and where the normal loading on the tooth in use is in any case relatively low.

Referring now to the metallic wire type card-cothing shown in FIGS. 2 and 3, it will be observed that there is a rib 20 and a tooth portion 22, and that one flank of the tooth portion is a continuation of the female flank of the rib 20. The rib in this construction is however of generally rectangular shape with a height greater than its thickness. The general shape of the rib is instrumental in achieving certain manufacturing and user advantages as will be hereinafter mentioned. The pitch width of the wire in accordance with ISO/DIS 5234 is the width between the flanks of the rib, indicated at W in FIG. 2.

A female recess section 24 is formed in the female side of the rib and a male protrusion section 26 is formed on the opposite (male) side of the rib. The female section has a flat inside wall 28 and top and bottom side walls 30 and 31 each of which has the contour of a pair of reversed intersecting radii as seen in cross-section.

It will be observed, that the depth of the female section—measured along a line perpendicular to the female flank—is much less than the corresponding depth of the female section in the V-shaped rib shown in FIG. 1. For example, whereas the V-shaped female section extends well beyond the projection of the root of the tooth portion 12, the female section of the wire shown in FIG. 2 is not so deep as the projection of the root of the tooth. In comparing the depth of the female section with the thickness of the root portion of the tooth, the radius joining the tooth portion to the rib portion is ignored, and reference is made to a theoretical tooth thickness at the intersection of the projection of the inclined flank of the tooth portion with the projection of the top shoulder of the rib. Furthermore, it will be observed that the depth of penetration of the female section is less than half the rib pitch width W. In a specific example, where the rib has a pitch width of 0.9 millimeters—measured from the female flank to the male flank and ignoring the male projection—the depth of the female section is about 0.30 millimeters. In any event, it is preferred that the depth of the female section shall not exceed 0.7 millimeters.

The female section is wide (measuring the width vertically in FIG. 2) relative to its depth. Moreover, the construction illustrated in FIG. 2 provides significantly greater resistance against bending of one part of the rib relatively to another part, such as is required in order to close up the female section than is provided by the V-type section card-clothing illustrated in FIG. 1. Since this improved resistance to bending virtually eliminates closing of the female section, it becomes possible to apply the correct number of convolutions of the wire per unit length of the roller regardless of the diameter of the roller, because the male section can properly be seated in the female section.

It has been found in practice, that wire having an interference of about 0.3 millimeters between adjacent convolutions brought about by engagement of the male portion 26 in the adjacent female portion 24 is very effective and is well adapted to resist rib breakage after mounting on the card. Furthermore, it has now been shown to be practicable, to manufacture card-clothing wire in the form shown in FIGS. 2 and 3, with a pitch width permitting 28 rows per 25 millimeters axial length of the carding machine roller. It is assumed that it will be possible to manufacture wire down to pitch widths which will permit 40 or even 50 rows per 25 millimeters axial length of the roller. At the same time, it will be appreciated that the wire in accordance with the invention, as illustrated in FIGS. 2 and 3, can be made in larger sizes, and certainly it is expected to be successful up to wire adapted to produce 16 rows per 25 millimeters axial length of the roller.

One of the advantages of the interlocking wire made in accordance with the invention is that it can be manufactured at lower cost than the V-shaped interlocking wire, because it can be produced from standard card-clothing wire, in terms of dimensions and steel type. This is not possible with the known V-type interlocking wire, because the cross-section is relatively complex. Moreover, the simpler cross-section of the wire which can be used, allows the use of higher grade steels than are possible with the V-shaped inerlocking wire, and hence the card-clothing can be given a better wear resistance. Furthermore, the tooth blade sizes on the interlocking wire made in accordance with the invention can be dimensionally finer than the sizes which are normally produced on the V-shaped wire type, and hence can be made more compatible with existing non-interlocking wire on existing carding machines. Hence, less compromises are required when converting exising carding machines from non-interlocking to interlocking wire.

The shape of the male and female sections may be varied from that illustrated. For instance, these sections may be semi-circular or rectangular in cross-section.

I claim:

1. Interlocking metallic wire type card-clothing having a rib portion and a tooth portion, a male section protruding along one side of said rib, and a female section formed in the other side of said rib, the pitch width of said rib measured from one flank to the other being not greater than 1.65 millimeters, and the maximum depth of said female section, measured from the flank of the female side of said rib, and perpendicular to that flank, being not substantially greater than half the pitch width of said rib.

2. Interlocking metallic wire type card-clothing according to claim 1, wherein the maximum depth of the female section is not more than 0.7 millimeters.

3. Interlocking metallic wire type card-clothing according to claim 1, wherein the maximum depth of the female section is not more than 0.5 millimeters.

4. Interlocking metallic wire type card-clothing according to claim 3, wherein the pitch width of the rib is not more than 1.1 millimeters.

5. Interlocking metallic wire type card-clothing according to claim 1, wherein the maximum depth of the female section is not greater than the theoretical thickness of said tooth portion at the root of teeth formed in said tooth portion.

6. Interlocking metallic wire type card-clothing according to claim 5, wherein the maximum depth of the female section is not more than 0.8 times the theoretical thickness of said tooth portion at the root of the teeth.

7. Interlocking metallic wire type card-clothing according to claim 1, wherein the pitch width of the rib is not more than 0.92 millimeters.

8. Interlocking metallic wire type card-clothing according to claim 1, wherein said rib is generally of rectangular cross-section, the rib height being greater than the rib thickness, and wherein one flank of said tooth portion forms a continuation of the female flank of said rib.

9. Interlocking metallic wire type card-clothing according to claim 1, wherein said male section has a cross-section corresponding substantially to that of said female section, so that said male section is adapted to fit snugly into said female section of an adjacent convolution of the wire.

10. Interlocking metallic wire type card-clothing according to claim 1, wherein said female section has a flat inside wall.

* * * * *